US005195733A

United States Patent [19]

Takimoto et al.

[11] Patent Number: 5,195,733

[45] Date of Patent: Mar. 23, 1993

[54] RESTORATIVE SHEET TRANSPORT APPARATUS

[75] Inventors: Kazushi Takimoto, Kadoma; Yasushi Kamezaki, Sakai; Yukio Tanisaki, Hyogo, all of Japan

[73] Assignee: Mita Industrial Co., Ltd., Japan

[21] Appl. No.: 858,403

[22] Filed: Mar. 27, 1992

[30] Foreign Application Priority Data

Apr. 1, 1991 [JP] Japan ..... 3-96274
Apr. 1, 1991 [JP] Japan ..... 3-96275

[51] Int. Cl.[5] ..... B65H 5/00

[52] U.S. Cl. ..... 271/3.1; 271/188; 271/200

[58] Field of Search ..... 271/188, 3.1, 3, 4, 271/6, 7, 200

[56] References Cited

U.S. PATENT DOCUMENTS 4,145,041 3/1979 Kew ..... 271/188 X
4,469,319 9/1984 Robb et al. ..... 271/3.1
4,469,436 9/1984 Jones et al. ..... 271/3.1 X
4,761,001 8/1988 Hayakawa et al. ..... 271/3.1
4,928,151 5/1990 Saeki ..... 271/3.1 X
4,957,285 9/1990 Yamada ..... 271/3.1

FOREIGN PATENT DOCUMENTS 2-204242 8/1990 Japan ..... 271/188

*Primary Examiner*—David H. Bollinger
*Attorney, Agent, or Firm*—Beveridge, DeGrandi, Weilacher

[57] ABSTRACT

A recirculating original-sheet transport apparatus supplies a sheet from a stack of original documents to the exposure station of an image forming apparatus and restores the sheet onto the stack. It includes a sheet container for receiving originals, a sheet feeder for feeding an original sheet from the sheet container to the image forming apparatus, and a sheet restorer for restoring the sheet into the sheet container. The sheet restorer includes a turning path in which is a plurality of soft rollers having guide ribs therebetween, and a straight transport path in which is a plurality of position-variable hard rollers around which transport belts extend and between which are guide ribs as well.

33 Claims, 10 Drawing Sheets

RESTORATIVE SHEET TRANSPORT APPARATUS

BACKGROUND OF THE INVENTION

The present invention relates to an original-sheets transport apparatus, and more particularly to an apparatus for feeding a sheet from a stack of original sheets to an image forming apparatus and restacking the sheet onto the stacked original sheets.

Japanese Patent Laying-Open No. 197236/1989 discloses an original-sheet transporting apparatus for use in a copying machine. The apparatus includes an original sheet container, a sheet feeder for feeding a sheet from the original sheet container onto an original sheet retainer of the copying machine, and a sheet restorer for restoring the fed sheet into the original container. The sheet restorer includes a turning path for turning the fed sheet, and a straight transport path extending from the turning path to the original sheet retainer. The turning and straight paths each have rollers, transport belts in C-shaped extension around the rollers, a belt driver for shifting portions of the transport belts adjacent the original container, and backup rollers pressing on the path rollers through the belts. The backup roller is shifted together with the portions of the transport belts adjacent the original sheet container by the belt driver.

The original-sheet transporting apparatus feeds an original contained in the original sheet container to the original retainer of the copying machine sheet by sheet. After an original is scanned by the copying machine, it is restored into the original sheet container by the sheet restorer. In the operation of the original restorer, the belt driver shifts the portion of the transport belts adjacent the original sheet container so as to accord with the sheet-size of the original; and the transport belts are circulated in order to transport the sheet between the belts and the backup roller.

Thus a conventional apparatus as therein disclosed requires a backup roller which presses on the transport belts and moves together with their position-shifting portions. This complicates the structure and increases the number of necessary mechanical parts. Furthermore, it is difficullt to remove a sheet which happens to jam in the sheet restorer, because the backup roller is positioned scarcely apart from the transport belts.

The disclosed conventional apparatus further includes a rear regulating plate in the original sheet container in order to bring the rear edges of the original sheets into adjustment. The sheet restorer restores a sheet into the original sheet container such that its rear edge lies near the rear regulating plate. After all of the sheets of original have been fed to the copying machine and restored, the rear regulating plate pushes the stack of originals toward the sheet feeder until the feed-forward end of the stack reaches the sheet feeder, whereby the sheets in the stack may be resupplied to the copying machine.

The pushing operation by the original restorer is effective to bring a stack of original sheets of identical size into alignment. However, it is at times desirable that a stack of sheets may include sheets of different sizes, such as A4-size and A5-size sheets, for example. In such a case in the conventional apparatus, some of the smaller-size sheets do not reach the sheet feeder when the rear regulating plate pushes the stack of original toward it. Consequently, the refeeding of each and every original from stack of different sizes is impossible.

SUMMARY OF THE INVENTION

An object of the present invention is to simplify the overall structure of an above-described type of sheet transport apparatus through a reduction in the number of parts and to facilitate the removal of a jammed sheet.

Another object is to simplify the belt-shifting structure in such a manner as to further facilitate jammed sheet removal.

A further object of the present invention is to enable the correct transport original sheets in a stack containing different sizes.

(1) An original-sheet transporting apparatus according to an aspect of the present invention feeds stacked sheets of original material to an image forming apparatus sheet by sheet, and subsequently restores the feed sheets onto the stack. It includes an original sheet container, a sheet feeder for feeding a sheet from the original sheet container to the image forming apparatus, and a sheet restorer for restoring the fed sheet into the original sheet container.

The sheet restorer includes a sheet turning path and a straight transport path. A plurality of soft rollers is disposed in the turning path, and guide ribs are located between the rollers. Disposed in the straight path is a plurality of hard rollers, transport belts extending around the hard rollers, and guide ribs located between the transport belts.

A stack of original sheets is received into the original container. The sheet feeder feeds the originals from the original container to the image forming apparatus sheet by sheet, and then the sheet restorer restores the fed sheets back into the original sheet container.

The sheet restorer in operation transports sheets through the turning path between the soft rollers and the guide ribs. Because the sheets are nipped between the soft rollers and the guide ribs, stress on the original sheets in the turning path is lessened. As they leave the turning path, the sheets are transported by the transport belts along the guide ribs in the straight path. The sheets are correctly transported by this original-sheets transporting apparatus, because they are nipped between the ribs and the belts extending around the hard rollers. Thus, the structure is simplified to eliminate the need for auxiliary rollers, which in the conventional apparatus are necessary. Furthermore, the guide ribs facilitate removal of a jammed sheet.

(2) According to another aspect of the present invention, the original restorer includes a plurality of transport belts in extension toward the original sheet container, a belt driver for shifting a portion of the belts adjacent the original sheet container, and guide ribs disposed between the transport belts extending along the range through which the belts are shifted by the belt driver.

The sheet restoring operation is carried out in accordance with a current sheet size, because the belt driver shifts the portion of the belts adjacent the original sheet container accordingly.

The structure of the belt driver therein is simplified, since there are no auxiliary rollers to be moved together with the shifting portion of the transport belts adjacent the original sheet container. Furthermore, elimination of the backup rollers eliminates an impediment to the removal of a jammed sheet.

(3) An original-sheet transporting apparatus according to yet another aspect includes a sheet retainer disposed in the sheet container for retaining the feed-forward end of a stack of originals contained therein. The original restorer restores the fed sheet into the original container such that the leading edge of the sheet reaches to the sheet retainer.

A stack of original sheets are contained in the sheet container, wherein the fore end of the stack is retained by the sheet retainer. Retained thus in adjustment, the originals are fed sheet by sheet from the sheet container to the image forming apparatus by the sheet feeder. Each fed sheet of the originals is restored into the sheet container by the sheet restorer such that the leading edge of the sheet reaches the sheet retainer fully.

Consequently, a stack of originals including sheets of different sizes may be correctly refed to the image forming apparatus in a multiple-copy operation, since the fed sheets are restored into the original sheet container such that the leading edges of the sheets sully arrive at the retaining part of the sheet retainer.

The foregoing and other objects, aspects and advantages of the present invention will become more apparent from the following detailed description.

DESCRIPTION OF THE PREFERRED EMBODIMENT

Figure 1:
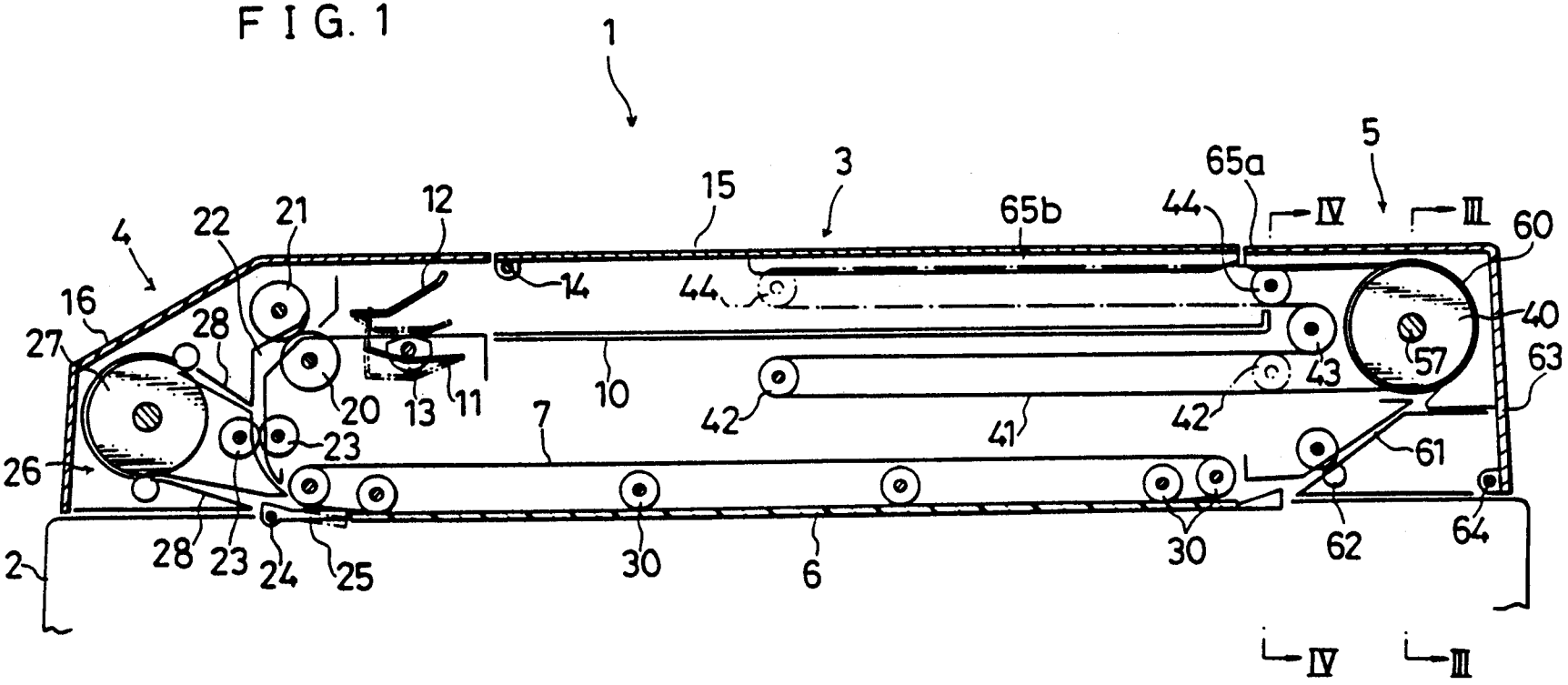
FIG. 1 is an elevational view of an original-sheet transporting apparatus according to the present invention.

Referring to FIG. 1, an original-sheet transporting apparatus according to the present invention is disposed as therein illustrated on the upper surface of a copying machine 2. The apparatus 1 includes a sheet container 3 disposed in the upper midportion thereof, containing sheets of original material to be copied, a sheet feeder 4 disposed along the left side of the sheet container 3, and a sheet restorer 5 disposed along the right side of the original container 3. A transport belt 7 is provided facing an original retainer 6, which is disposed in the upper portion of the copying machine 2.

The sheet container 3 has a receiving tray 10 on which a stack of originals is placed. A sheet stop 11 and a feed presser 12 provided at the end of the original tray 10 closest the sheet feeder 4, are shiftable by a solenoid (not shown) between the position indicated by solid lines and that indicated by phantom lines. When in the upper, solid-line indicated position, the rim of the sheet stop 11 projects upward from the original tray 10 wherein a stack of originals in the receiving tray 10 abuts against it. When in the lower, phantom-line indicated position, the whole of the sheet stop 11 is located lower than the receiving tray 10. The feed presser 12 is disposed over an advancing roller 13, and assumes the upper position in order to receive a stack of originals, and assumes the lower position in order to press on the received stack.

The advancing roller 13, disposed between the sheet stop 11 and the feed presser 12, is roughly semi-circular and is rotated by a motor (not shown). Due to its shape, the roller 13 periodically projects upward from the original tray 10 during its counterclockwise rotation, wherein it advances original sheets to the sheet feeder 4 in cooperation with the feed presser 12.

Located above the receiving tray 10 is a lid 15 pivotal upon a pivot 14. The pivot 14 is supported in a cover 16 which envelops the apparatus 1.

The sheet feeder 4 includes a feeding roller 20 and a separation roller 21 disposed adjacent the original tray 10. The pair of rollers 20 and 21 separate sheets of original transported from the receiving tray 10. Provided between the pair of rollers 20 and 21 and the transport belt 7 is a transportation path 22 consisting of a pair of plates. A pair of resist rollers 23 is provided in the transportation path 22 so as to regulate the position of sheets in transport. A switching lever 25 is provided at the end of the transportation path 22 closest to the transport belt 7, and is pivotal on a pivot 24 to assume the positions indicated by the solid and the phantom lines in FIG. 1.

A turner 26 is connected to the transportation path 22 and comprises a turning roller 27, and connecting paths 28 located between the turning roller 27 and the tansportation path 22.

The transport belt 7 extends around a plurality of rollers 30 which are disposed in parallel at intervals such that the belt 7 is extended along the original retainer 6 and its bottom-positioned portion traces the original retainer 6.

The sheet restorer 5 is provided in the right portion of the apparatus 1 in the figure wherein it connects with the transport belt 7 so as to recirculate sheets from the transport belt 7 into the sheet container 3. The sheet restorer 5 comprises large-diameter drive rollers 40 around which discharge belts 41 extend. The discharge belts 41 furthermore extend in parallel "U's" around end rollers 42 disposed below the receiving tray 10, auxiliary rollers 43 adjacent the drive rollers 40 and discharge rollers 44 disposed above the original tray 10.

Figure 2:
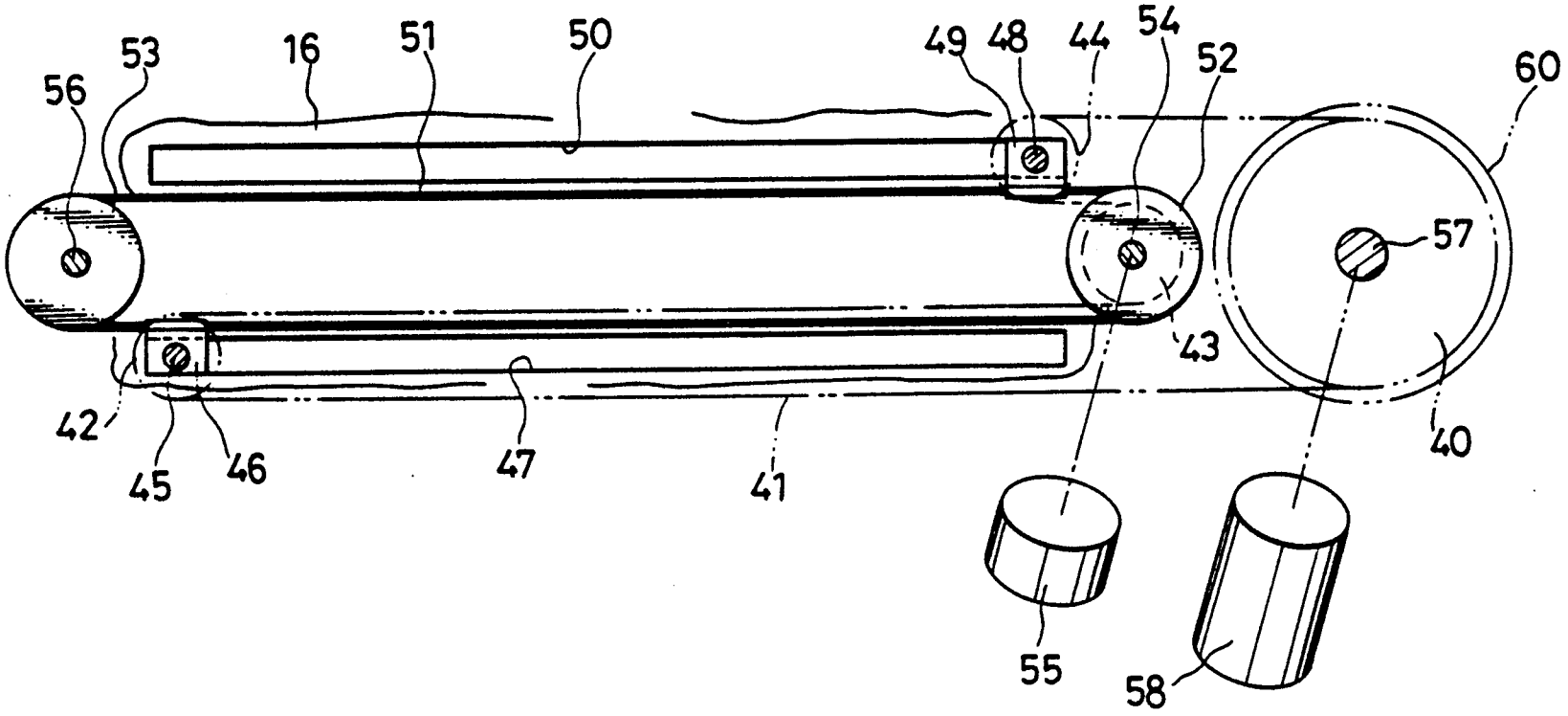
FIG. 2 is a schematic sectional view of a belt drive assembly.

Turning now to FIG. 2, the end roller 42 is shown to be mounted on an axle 45 supported by slidable bearing 46. The bearing 46 is slidable in a guide slot 47, formed in the apparatus cover 16, which extends parallel to the receiving tray 10 (FIG. 1). Meanwhile, the discharge roller 44 is mounted on an axle 48 supported by a slidable bearing 49. The bearing 49 is slidable in a guide slot 50 formed in a frame (not shown) in parallel with the guide slot 47.

Both of the bearings 46 and 49 are fixed to a belt 51 situated between the guide slots 47 and 50. The belt 51 extends around a pair of pulleys 52 and 53 which are located right and left of the guide slots as shown in FIG. 2. The pulley 52 (adjacent the drive rollers 40) is fixed onto an axle 54, which in turn is connected to a stepping motor 55. The pulley 53 is rotatable on an axle 56. Additionally, the auxiliary rollers 43 are rotatable on the axle 54.

Figure 3:
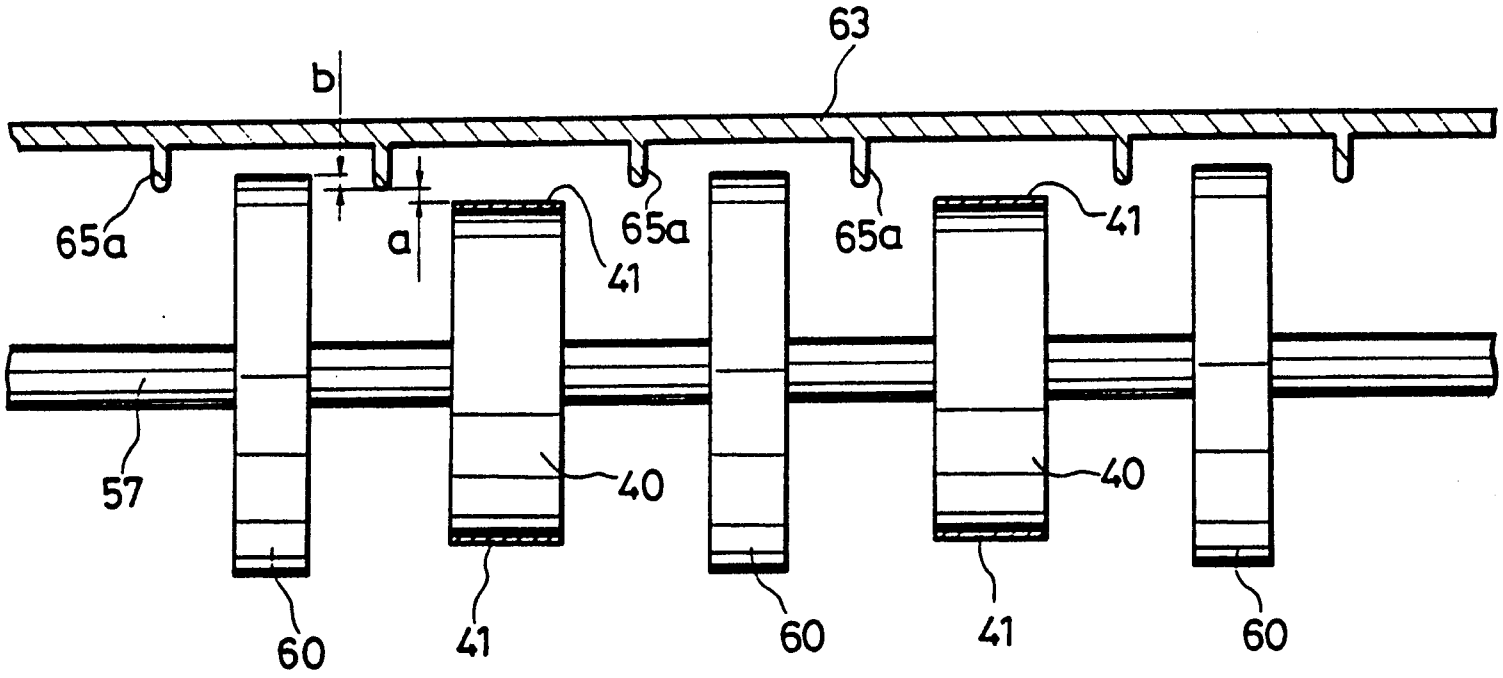
FIG. 3 is a sectional view taken along the line III—III of FIG. 1.

An axle 57 supporting the drive rollers 40 is connected to a DC motor 58. Furthermore, as shown in FIG. 3, sponge-rubber rollers 60 are disposed on either side of the drive rollers 40 along the axle 57. The sponge rollers 60 are made of an elastic polyurethane foam such as "Moltplane Foam" (INOAC CO., LTD., Japan), a material having an extremely lower stiffness than that of which the associated rollers 40, 42, 43 and 44 are made. As shown in FIG. 1, provided between the end of transport belt 7 closest to the sheet restorer 5 and the drive rollers 40 is a transportation path 61 consisting of a pair of plates. A pair of transport rollers 62 is provided in the transportation path 61.

A cover 63 encloses the drive rollers 40, the sponge rollers 60, etc. The cover 63 is pivotal on a pivot 64 which is fixed into the cover 16.

Formed on the inner surface of the cover 63 are ribs 65*a*. The ribs 65*a* extend from the end of the transportation path 61 closest to the drive roller 40 along the discharge belts 41 to the sheet container 3. As shown in FIG. 3, each rib 65*a* projects from the cover 63 along the radial direction of the sponge rollers 60 such that its edge is nearer the axle 57 by distance b than the circumferential surface of the sponge rollers 60. However, the edge of each rib 65*a* is farther from the axle 57 by distance a than are the discharge belts 41 wound over the drive rollers 40. Thus, the edge of each rib 65*a* projects to a limit lying within the range of the difference in diameter of the discharge belts 41 and the sponge rollers 60.

Figure 4:
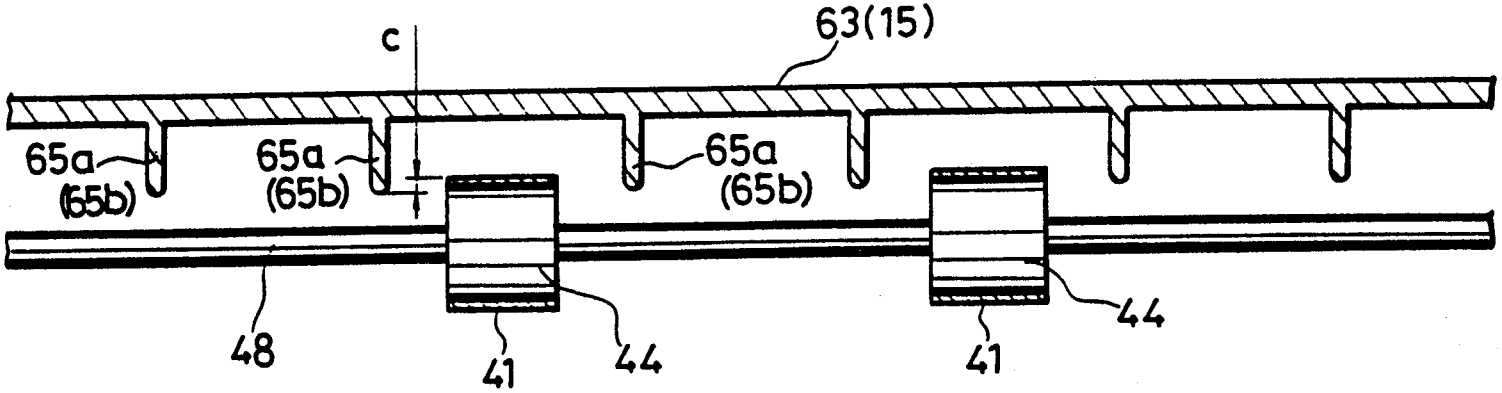
FIG. 4 is a sectional view taken along the line IV—IV of FIG. 1.

Turning back now to FIG. 1, the lid 15 is shown to have ribs 65*b* contiguous with the ribs 65*a* and extending along the range of movement of the discharge roller 44 between the positions indicated by solid and phantom lines. The ribs 65*b* are integrally formed in the lid 15 and structurally enforce it. The straight portion of the ribs 65*a*, project together with the ribs 65*b* from the inner upper surface of the cover 63 and from the inner surface of the lid 15 respectively, as shown in FIG. 4. The edge of the ribs 65*a*/65*b* are located nearer the axis 48 by distance c than the outer surface of the discharge belts 41 wound over discharge rollers 44.

Figure 5:
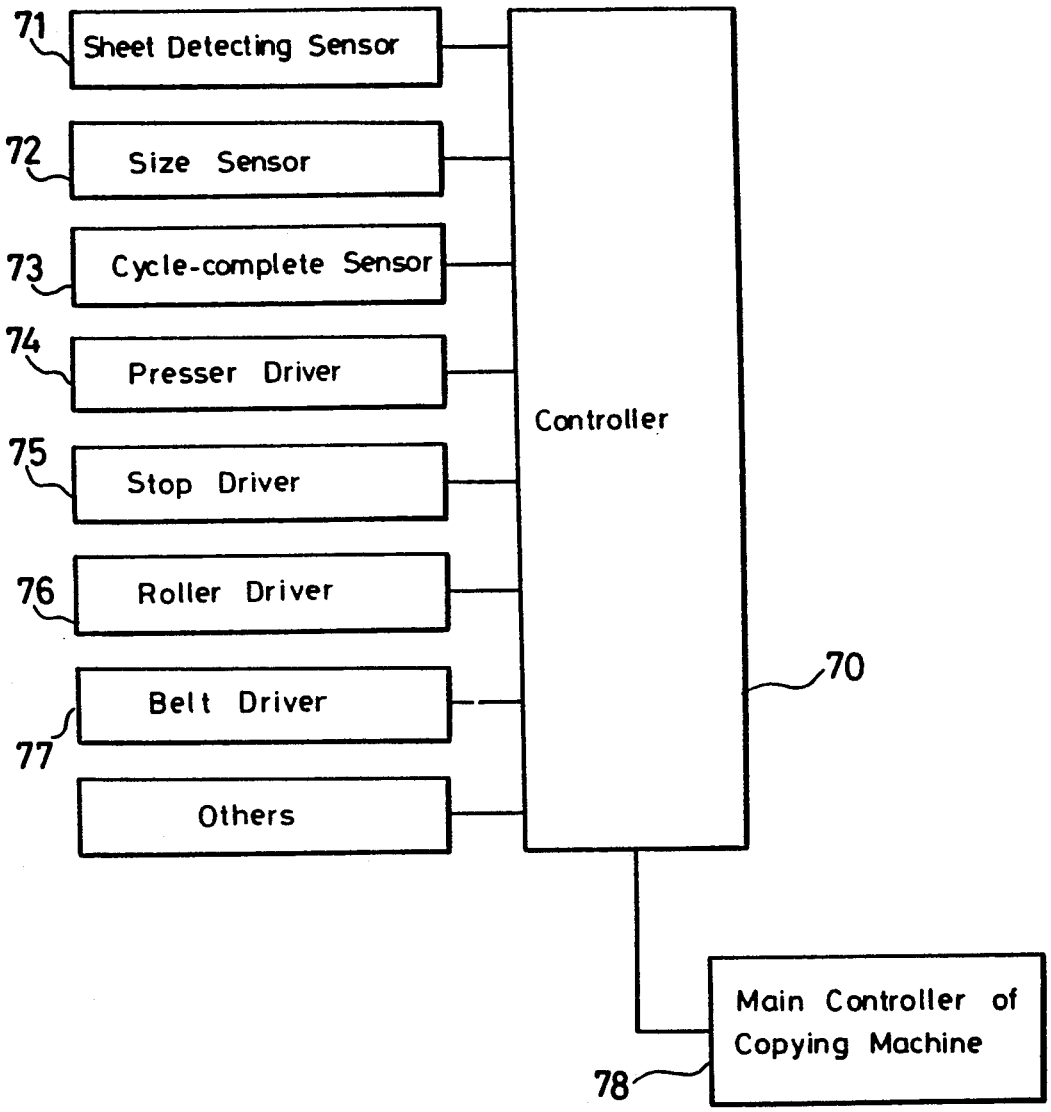
FIG. 5 is a schematic diagram of a control unit.

FIG. 5 diagrams a controller 70 of the original-sheet transporting apparatus 1, shown to include a microcomputer consisting of a CPU, a ROM, a RAM, inter alia. Connected with the controller 70 are a sheet detecting sensor 71 for determining whether an original is in the receiving tray 10, a size sensor 72 for determining the size of sheets passing through the transportation path 22, a cycle-complete detecting sensor 73 for determining whether one cycle circulating a stack of originals in the receiving tray 10 is completed. Also connected with the controller 70 are a driver 74 for the feed presser 12, a driver 75 for the sheet stop 11, a driver 76 for the discharge rollers 44 through the stepping motor 55, a driver 77 for circulating the discharging belts 41 through the DC motor 58, and miscellaneous input/output members. The copying machine main controller 78 provided in the copying machine 2 is further connected with the controller 70.

An explanation of the operation of the above-described embodiment follows, with reference made to the program illustrated by the flow charts of FIGS. 7 to 11.

Figure 7:
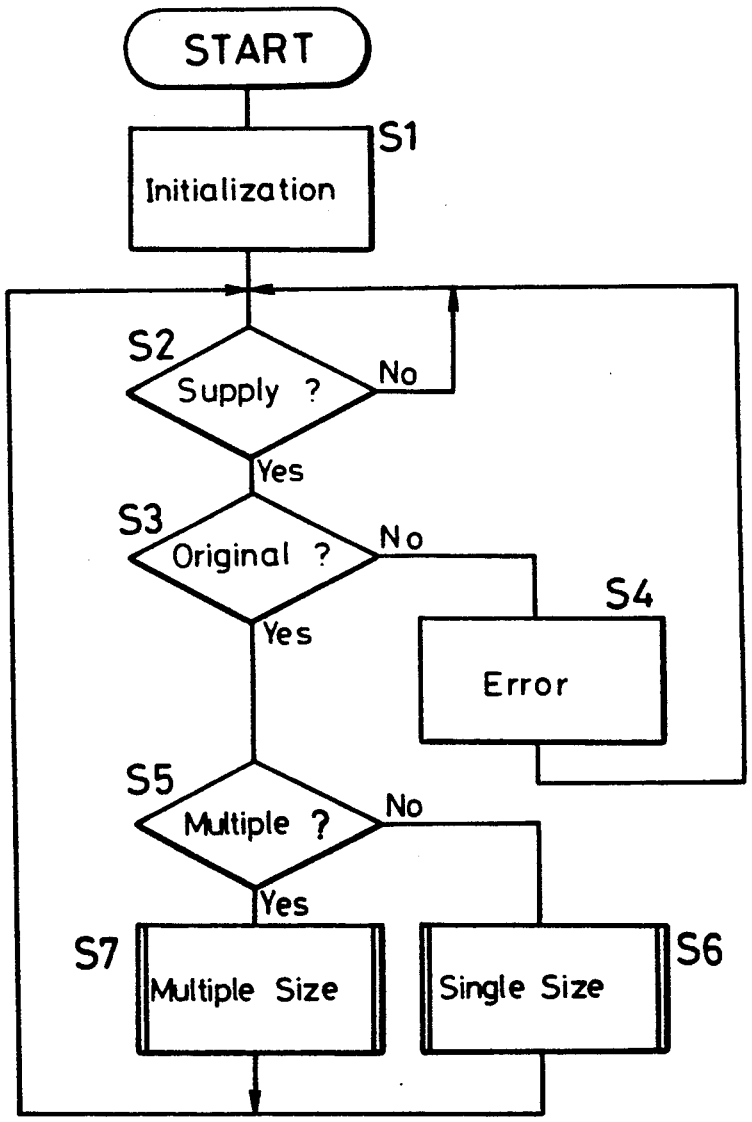
FIGS. 7–11 are each control process flow charts of the apparatus.

As the program starts, initialization step S1 shown in FIG. 7 is executed, whereby the sheet stop 11 and feed presser 12 are positioned into the locations indicated by solid lines in FIG. 1.

After initialization, step S2 is executed, at which the program awaits an original supply command, which is issued by the main controller 78 of the copying machine. Upon receiving the command, step S3 is executed, wherein the sheet detecting sensor 71 determines whether an original exists in the receiving tray 10. In case there is no original, step S4 is executed in response to the fact that the apparatus 1 cannot supply any sheets to the copying machine 2. At step S4, an error procedure such as delivering an error signal to the main controller 78 is carried out. Following step S4, the program returns to step S2.

When the presence of original material is detected at step S3, step S5 executed, at which it is determined whether a multiple-size mode is designated by reference to the state of the operation mode of the copying machine main controller 78. If the multiple-size mode is not designated, step S6 is executed, which performs an ordinary sheet-transporation operation. If the multiple-size mode is otherwise designated, step S7 is executed, which performs a multiple-size mode transportation operation.

Figure 8:
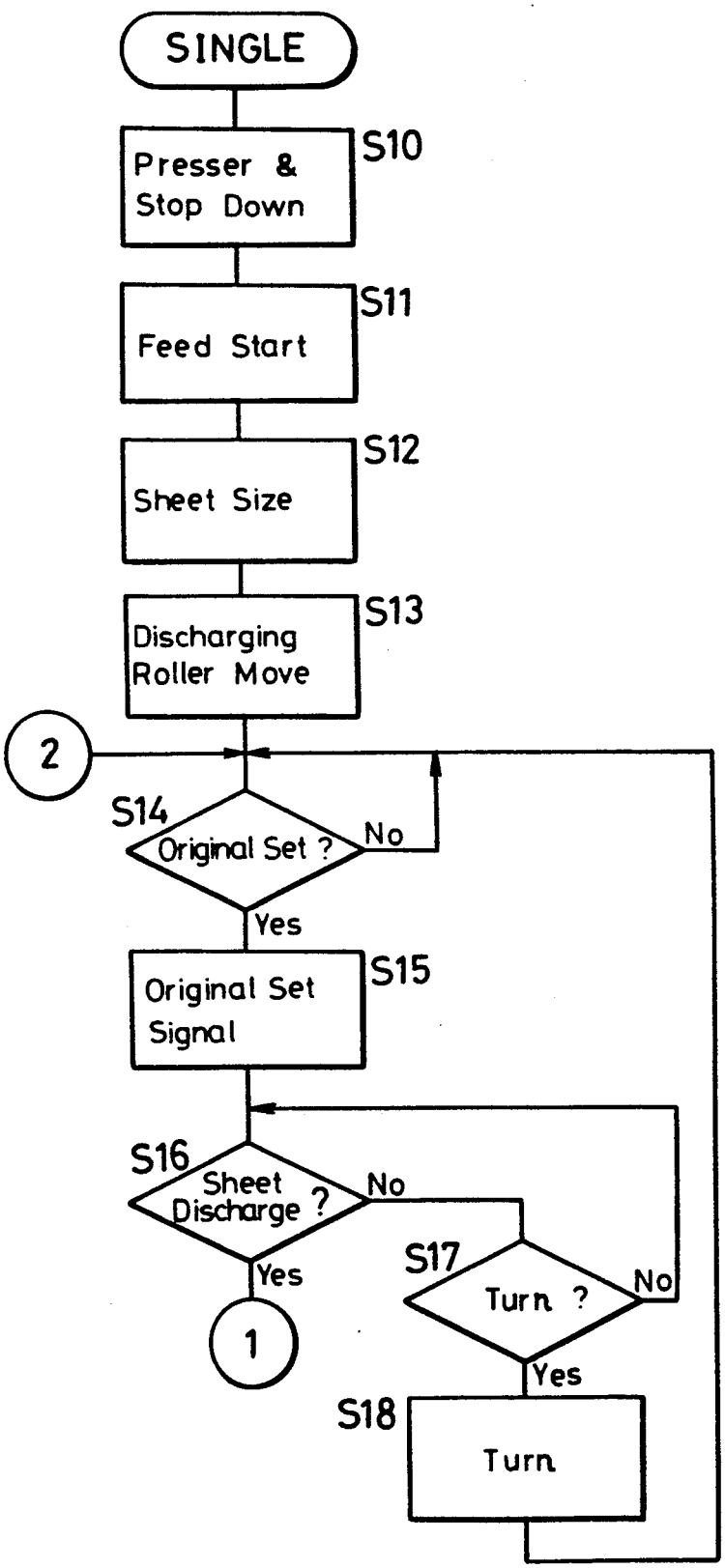
Figure 9:
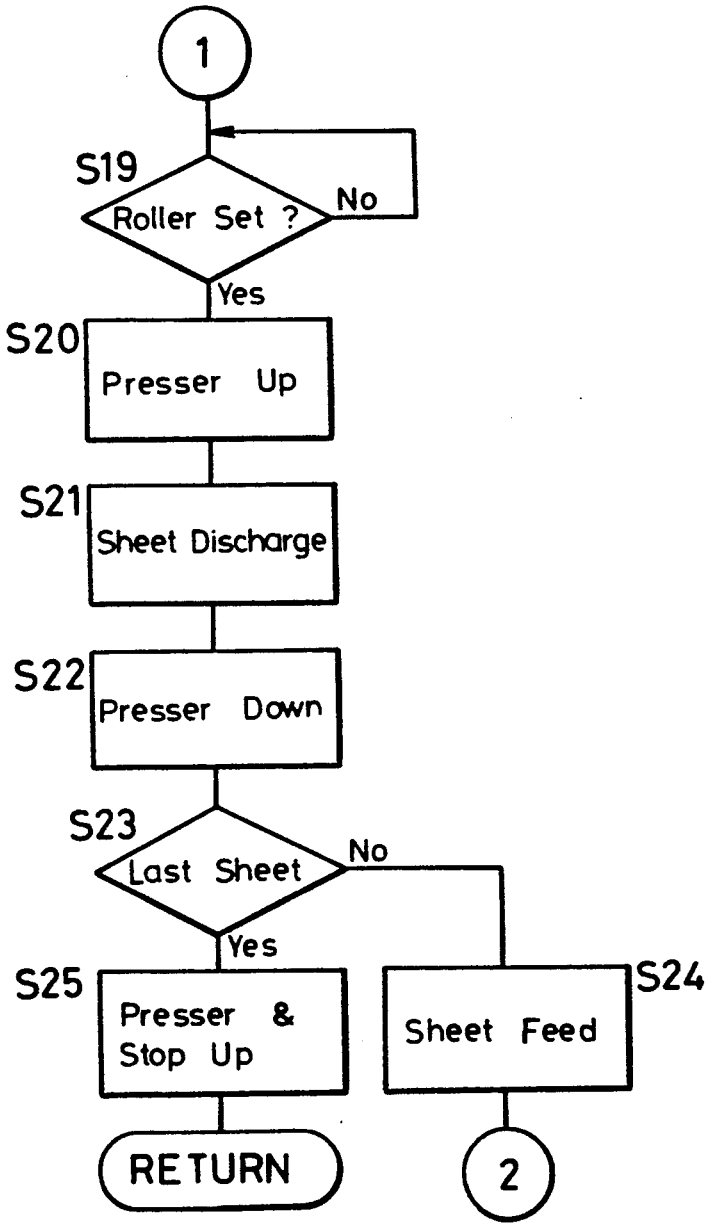

FIGS. 8 and 9 illustrate the execution of an ordinary transportation operation at step S6.

At step S10 in FIG. 8, the sheet stop 11 and feed presser 12 are lowered into the position indicated by phantom lines in FIG. 1. As a result, the stop 11 allows an original to pass, and the feed presser 12 presses the received end of the originals against the advancing roller 13.

Next, at step S11, a feed-start command is issued, wherein a series of sheet-feeding operations are executed, and the feeding roller 20 begins counterclockwise rotation. At step S12, the length of an original sheet passing through the transportation path 22 is determined by the size sensor 72. Subsequently, shifting of the discharge rollers 44 is started at step S13. The discharge rollers 44 are moved by the stepping motor 55 shown in FIG. 2. The turning of the stepping motor 55 drives the belt 51, whereby the bearing 46 is slid along in the guide slot 47 and the bearing 49 is counter slid along the guide slot 50. The extent of discharge rollers 44 shift has therein been determined in correspondence with the sheet length determination at step S12.

Step S14 awaits the completion of the sequence of operations for positioning one sheet of original onto the original retainer 6, whereupon step S15 is executed. At step S15, an "original set" signal, indicating that an original sheet is positioned onto the original retainer 6, is delivered to the main controller 78 of copying machine 2. Then the copying machine 2 receives the set signal, it optically scans the original sheet located on the original retainer 6 so as to obtain image information therefrom, and executes the normally ensuring copying operations in which a toner image is transferred onto a printing sheet.

At steps S16 and S17, commands issued by the main controller 78 for original-sheet discharge and turning are awaited. If image information is to be obtained from both sides of the sheet, the program proceeds from step S17 to step S18, since a turning command will have been issued from the main controller 78. At step S18, a turning operation employing the turning roller 27 is carried out. Following step S18, the program returns to step S14 in order to wait the completion of relocating the turned sheet onto the original retainer 6. Then, steps S14 etc. are repeated.

When a sheet-discharge command is issued from the main controller 78, the program proceeds from step S16 to step S19 of FIG. 9. Step S19 awaits the completion of the shifting of the discharge rollers 44, whereupon step S20 is executed, which moves the feed presser 12 upward into the solid-line indicated position. Consequently, the stack of originals is released from the pressure of the feed presser 12.

At step S21, a sheet-discharge command is issued. Accordingly, the transport belt 17 begins to circulate, and the DC motor 58 starts rotating the axis 57. As a result, the discharge belts 40 begin to circurlate, and the sponge rollers 60 start rotating. By the execution of step S21, the sheet located on the original retainer 6 is transported therefrom through the transportation path 61 of the sheet restorer 5.

Once in the sheet restorer 5, the original sheet, guided by the ribs 65*a* and 65*b*, is transported toward the receiving tray 10 by the sponge rollers 60 which nip the sheet due to distance b by which the ribs 65*a* and the sponge rollers 60 overlap radially. Although the sheet is thus turned on the sponge rollers 60, it is not subject to such deterioration as wrinkling, due to the low-stiffness sponginess of the rollers 60.

After passing the sponge rollers 60, the sheet, further guided by the ribs 65*a*/65*b*, is transported by the discharge belts 41 extending around the discharge rollers 44, which nip the sheet. Although the discharge rollers 44 are of high stiffness, the sheet is not subject to deterioration, since it is transported straight. The sheet nipped between the ribs 65*a*/65*b* and the discharge belts 41 is transported toward the sheet feeder 4 until the leading edge of the sheet reaches to just under the feed presser 12.

Subsequent to step S21, step S22 is executed, which shifts the feed presser 12 into its downward position. As a result, the original sheet restored by the sheet restorer 5, as well as the original sheets remaining stacked in the receiving tray 10, are held in retention by the feed presser 12.

The cycle-complete sensor 73 determines at step S23 whether the restored sheet is the last sheet of a stack of originals. If not, the step S24 is executed, which supplies the bottom sheet of the stacked originals in the receiving tray 10 to the original retainer 6. Following step S24, the program returns to step S14 of FIG. 8.

When the restored sheet is otherwise the last sheet at step S23, step S25 is executed, which raises the sheet stop 11 and feed presser 12 into their upper positions. Since the stack of originals is thus released from the feed presser 12, an operator can remove the stack after opening the lid 15. After step S25, the program returns to the main routine shown in FIG. 7.

Therein, when the multiple-size mode has been designated at step S5, a multiple-size sheet transport process is carried out at step S7.

Figure 10:
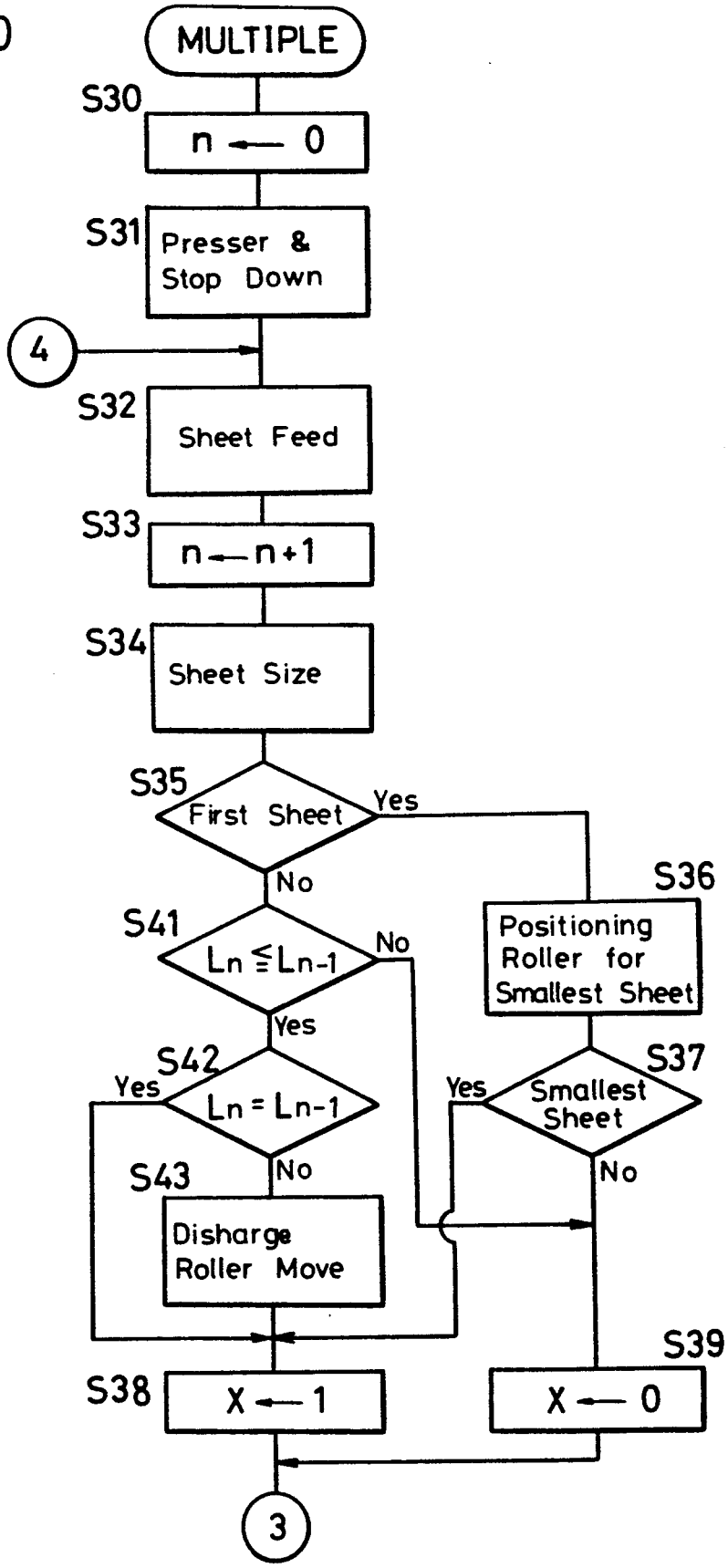

Referring now to FIG. 10, which illustrates the steps involved in the multiple-size sheet transport process, step S30 is executed first, in which a counter n for counting pages of the original material is set to "0". Then the sheet stop 11 and feed pressor 12 are lowered at step S31. At step S32, a sheet feeding process, identical to that at step S11 of FIG. 8, is started.

Step S33 increments the counter n by one. At step S34, the length of the transported sheet is determined likewise as at step S12.

It is determined at step S35 by reference to the value of the counter n whether the transferred sheet is the first sheet from the stack of originals. When this is the case, step S36 is executed.

At step S36, the discharging rollers 44 are shifted to the position corresponding to the smallest sheet which can be handled by the original-sheet transporting apparatus 1. The shifting operation is essentially the same as that at step S13. It is then determined at step S37 whether the transported sheet is the minimum size by reference to the value of the determination made at step S34. If it is of minimum size, step S38 is executed, through which an index X is set to "1". If it is otherwise determined at step S37 that the size of the transported sheet is not the minimum, step S39 is executed through which the index X is set to "0". A "1" setting in the index X signifies that the discharge rollers 44 are positioned properly, and a "0" signifies that they are not.

Figure 11:
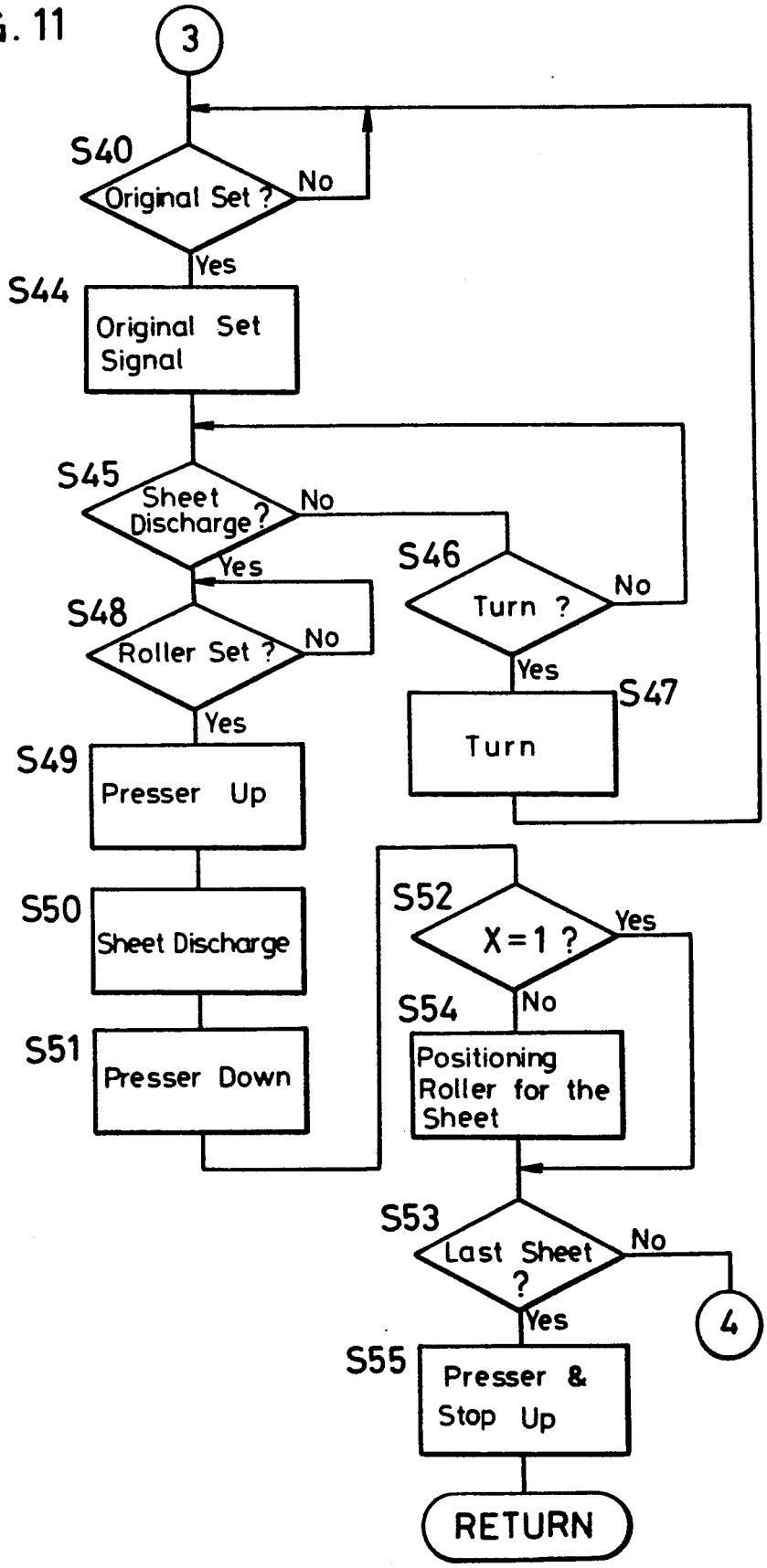

Following either step S38 or step S39, step S40 of FIG. 11 is executed.

If at step S35 of FIG. 10 the transported sheet is found not to be the first sheet from the original stack, step S41 is otherwise executed. At step S41, the length of the sheet in current transport is compared with that of the immediately proceeding sheet, and it is determined whether the currently transferred sheet is the same or smaller in size than the previous one. When the sheet in current transport is longer than the previous one, the program proceeds from step S41 to step S39, which sets the index X to "0".

If a "Yes" is concluded at step S41, step S42 is executed in which it is determined whether the sheet in current transport and the previous sheet are of the same length. If so step S38 is executed, which sets the index X to "1". Otherwise, if a "No" is concluded at step S42, step S43 is executed, in which the discharge rollers 44 are repositioned into the location which corresponds to the length of the sheet in current transport. As a result, the discharge rollers 44 are position toward the feed presser 12 beyond the trailing edge of the prior-restored sheet (i.e., the sheet which has been restored into the receiving tray 10). After the execution of step S43, step S38 is executed, which sets the index X to "1".

Steps S40, and S44 to S51 of FIG. 11 are identical to steps S14 to S22 of FIGS. 8 and 9, and hence will not be described in furher detail. However, it is to be noted that when a sheet is discharged at step S50, the discharge rollers 44 either remain located in the position in which they were located to discharge and restore the prior-restored sheet, or will have been located closer to the sheet feeder 4. Accordingly, the sheet in current transport cannot knock against the trailing edge of the prior-restored sheet when it is restored onto the stack of originals in the receiving tray 10 through the sheet restorer 5. In particular, the sheet in current transport is correctly positioned such that its leading edge is located under the feed presser 12.

Step S52 follows step S51 and sets the index X to "1", whereupon the program proceeds to step S53 since the discharge rollers 44 will have been positioned correctly for the transported sheet. If the index X is otherwise "0", step S54 is executed to shift the discharge rollers 44 into position corresponding to the length of the transported sheet. Thus, following step S54, step S53 is enabled. If in this latter case step S54 were not executed, the discharge rollers 44 would be located too close to the sheet feeder for the length of the transported sheet, such that it could not be completely set onto the stack of originals in the receiving tray 10 because the trailing end of the transported sheet would not leave the discharging belts 41.

Thus, if the sheet in current transport is longer than the prior-restored sheet, the discharge rollers 44 are repositioned at step S54. Consequently, since the discharge rollers 74 are repositioned so as to correspond to the length of the sheet in current transport, the sheet in current transport is fully restored into the stack of originals in the receiving tray 10 such that a next-fed sheet will not collide with its tailing end as it is restored.

Figure 6:
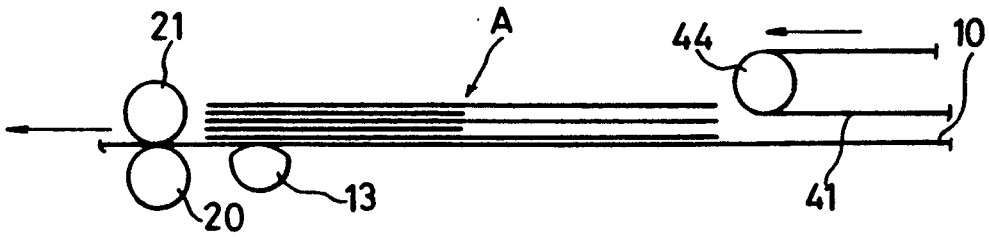
FIG. 6 is a schematic view of original sheets loaded into the apparatus.

FIG. 6 shows a stack (A) of original sheets which all have been supplied to the copying machine 2 and returned into the original tray 10 in the multiple-size mode. As is apparent from the situation diagramed in FIG. 6, the aforedescribed multiple-size mode process bring the leading edges of the original sheets in the receiving tray 10 into adjustment even should the stack consist of multiple-size original sheets. This ensures, consequently, that during a multiple-copy operation each sheet of original will be individually retransported from the stack during the next supply cycle of the sheets to the copying machine 2, irrespective of size.

At step S53 of FIG. 11, it is determined whether the sheet in current transport is the last sheet of the stack by reference to the determination by the cycle-complete sensor 73. If the sheet is not the last one, the program returns to step S32 of FIG. 10 and executes the following steps. If otherwise the determination is "Yes" at step S53, step S55 is executed, which raises the sheet stop 11 and feed presser 12 into their upper positions, and then the program returns to the main routine of FIG. 7.

If during a transportation operation as aforediscussed, a sheet jam occurs in the sheet restorer 5, an operator may remedy it as follows: first the lid 15 is opened by turning it on the pivot 14, and likewise the cover 63 is turned open on the pivot 64. The jammed sheet is therein easily removed, since the ribs 65*a* and 65*b* along the lid 15 and cover 63 leave away from the belts 41 and rollers 40 and 60.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. An apparatus for transporting a sheet from a stack of original material to an image forming apparatus and restoring the sheet onto the stack, comprising:

an original sheet container;

a sheet feeder for feeding a sheet from said original sheet container to said image forming apparatus; and a sheet restorer for restoring said sheet into said original sheet container, said sheet restorer including a turning path which has a plurality of rollers that have a relatively low stiffness and at least one guide rib between adjacent pairs of said rollers having said relatively low stiffness, and a straight transport path which has a plurality of rollers that have a relatively high stiffness and that are adapted to shift with respect to said path, transport belts extending around said rollers having said relatively high stiffness and at least one guide rib between adjacent pairs of said transport belts.

2. An apparatus according to claim 1, wherein said sheet restorer is provided adjacent said original sheet container; said turning path is provided to guide said sheet from said image forming apparatus to said straight transport path; and said straight transport path is provided to guide said sheet from said turning path to said original sheet container.

3. An apparatus according to claim 2 further comprising a cover enclosing said turning path and said straight transport path, wherein said rib disposed in said paths is formed on the apparatus-inward surface of said cover.

4. An apparatus according to claim 3, wherein said cover is openable.

5. An apparatus according to claim 4, wherein said rib of said turning path extends radially inward of said rollers having said relatively low stiffness, toward their axis of rotation; and said rib of said straight path extends radially inward of said rollers having said relatively high stiffness, toward their axis of rotation.

6. An apparatus according to claim 5, wherein said turning path further has a plurality of roller having saind relatively high stiffness of lesser diameter than, and disposed coaxially with, said rollers having said relatively low stiffness; and wherein the extent of said guide rib radially inward of said rollers in said turning path is within a region defined by the diametrical difference of the same.

7. An apparatus according to claim 6, wherein said rollers having said relatively low stiffness are formed of elastic polyurethane foam.

8. An apparatus according to claim 1, wherein said sheet restorer further has shiftable guide belts and means for shifting said guide belts in the direction toward said original sheet container, and wherein said guide rib of said straight transport path is disposed between said guide belts and extends at least along a range of shifting of said belts.

9. An apparatus according to claim 8 further comprising:

means for detecting sheet size; and means for controlling said belt-shifting means, whereby said belts are positioned so as to correspond to a sheet size as detected by said sheet-size detecting means.

10. An apparatus according to claim 9, wherein said sheet restorer further includes a drive roller, an auxiliary roller disposed adjacent said drive roller, an end roller which is shiftable below said original sheet container, and a discharge roller which is shiftable above said original sheet container; and said transport belts extend around said drive roller, end roller, auxiliary roller and discharge roller.

11. An apparatus according to claim 10, wherein said belt-shifting means shifts said end roller and said discharge roller synchronously in opposite directions.

12. An apparatus according to claim 1, wherein said original sheet container incorporates a tray into which said stack of original material is received; and includes a stop, disposed at an end of said tray nearest said sheet feeder, for retaining said stack within said tray, and means for advancing a sheet from said stack received in said tray toward said sheet feeder.

13. An apparatus according to claim 12, wherein said sheet feeder includes sheet-separation means disposed adjacent said tray, and a resist roller for regulating the position of a sheet transferred toward said image forming apparatus.

14. An apparatus according to claim 13 further comprising a sheet-transfer circulating belt disposed such that it faces onto an original retainer of said image forming apparatus and is between said sheet feeder and said sheet restorer; wherein said original sheet container is located between said sheet feeder and said sheet restorer, and said circulating belt is located below said original sheet container.

15. An apparatus for transporting a sheet from a stack of original material to an image forming apparatus and restoring the sheet onto the stack, comprising:

an original sheet container;

a sheet feeder for feeding a sheet from said original sheet container to said image forming apparatus; and a sheet restorer for restoring said sheet into said original sheet container, said sheet restorer including a plurality of transport belts extending toward said original sheet container, belt-shifting means for shifting said transport belts so as to extend further toward said original sheet container, and at least one guide rib disposed between said transport belts and extending at least along the range of said shifting of said transport belts.

16. An apparatus according to claim 15 further comprising:

means for detecting sheet size; and means for controlling said belt-shifting means whereby said transport belts are positioned so as to correspond to the sheet size as detected by said sheet-size detecting means.

17. An apparatus according to claim 16 further comprising a cover enclosing said sheet restorer, wherein said guide rib is formed on an inner surface of said cover.

18. An apparatus according to claim 15, wherein said sheet restorer further includes a drive roller, an auxiliary roller disposed adjacent said drive roller, an end roller which is shiftable below said original sheet container, and a discharge roller which is shiftable above said original sheet container; and said transport belts extend around said drive roller, end roller, auxiliary roller and discharge roller.

19. An apparatus according to claim 18, wherein said belt-shifting means shifts said end roller and discharge roller synchronously in opposite directions.

20. An apparatus according to claim 19, wherein said discharge roller is positioned opposite said guide rib, and the extent of said guide rib toward the axis of rotation of said discharge roller is beyond the circumferential surface thereof.

21. An apparatus according to claim 15, wherein said original sheet container includes a tray into which said stack of original material is received, a stop disposed at an end of said tray nearest said sheet feeder, for retaining said stack within said tray, and means for advancing a sheet from said stack received in said tray toward said sheet feeder.

22. An apparatus according to claim 21, wherein said sheet feeder includes sheet-separation means disposed adjacent said tray, and a resist roller for regulating the position of a sheet transferred toward said image forming apparatus.

23. An apparatus according to claim 22 further comprising a sheet-transfer circulating belt disposed such that it faces onto an original retainer of said image forming apparatus and is between said sheet feeder and said sheet restorer; wherein said original sheet container is located between said sheet feeder and said sheet restorer, and said circulating belt is located below said original sheet container.

24. An apparatus for transporting a sheet from a stack of original material to an image forming apparatus and restoring the sheet onto the stack, comprising:

an original sheet container having a sheet retainer for retaining an end of said stack of original material;

a sheet feeder for feeding a sheet from said original sheet container to said image forming apparatus;

a sheet restorer for restoring said sheet into said original sheet container, whereby the leading edge of said restored sheet is retained by said sheet retainer, said sheet restorer including means for transporting said sheet toward said original container, means for shifting said transport means in extension toward said original container, means for determining sheet size, means for controlling said shifting means, whereby said transport means are positioned in correspondnece with a sheet size as determined by said size-determining means;

means for determining whether a multiple-size mode for handling a stack of originals containing a plurality of sheet sizes is designated; and means for determining whether a sheet in current transport is shorter than a prior-restored sheet when said multiple-size mode is designated; wherein said control means directs the shifting of said transport means by said shifting means so as to correspond to the sheet size determination of a said sheet in currrent transport, only wherein it is shorter than said prior restored sheet, and wherein said control means directs the shifting of said shifting means such that said transport means remains located in the same position in which it was located for a prior-restored sheet, and after the sheet in current transport is fully placed in said original sheet container, is placed at the position corresponding to the drop-off point of the trailing edge of the sheet in current transport, wherein said sheet in current transport is longer than a said prior-restored sheet in said multiple-size mode.

25. An apparatus according to claim 24, wherein said transporting means includes a plurality of transport belts extending toward said original sheet container, and said shifting means includes belt-shifting means for shifting said transport belts so as to extend further toward said original sheet container.

26. An apparatus according to claim 25, wherein said sheet restorer includes at least one guide rib disposed between said transport belts and extending at least along the range of said shifting of said transport belts.

27. An apparatus according to claim 24, further comprising a cover enclosing said sheet restorer, wherein said guide rib is formed on an inner surface of said cover.

28. An apparatus according to claim 27, wherein said transport means further includes a drive roller, an auxiliary roller disposed adjacent said drive roller, an end roller which is shiftable below said original sheet container, and a discharge roller which is shiftable above said original container; and said transport belts extend around said drive roller, end roller, auxiliary roller and discharge roller.

29. An apparatus according to claim 28, wherein said belt shifting means shifts said end roller and discharge roller synchronously in opposite directions.

30. An apparatus according to claim 29, wherein said discharge roller is positioned opposite said guide rib, and the extent of said guide rib toward the axis of rotation of said discharge roller is beyond the circumferential surface thereof.

31. An apparatus according to claim 24, wherein said original sheet container further incorporates a tray into which said stack of original material is received; and said sheet retainer includes a stop, disposed at an end of said tray nearest said sheet feeder, for retaining said stack within said tray, and a presser for pressing on the uppermost surface at an end of said stack of original material received in said tray.

32. An apparatus according to claim 31, wherein said sheet feeder includes sheet-separation means disposed adjacent said tray, and a resist roller for regulating the position of a sheet transferred toward said image forming apparatus.

33. An apparatus according to claim 32 further comprising a sheet-transfer circulating belt disposed such that it faces onto an original retainer of said image forming apparatus and is between said sheet feeder and said sheet restorer; wherein said original sheet container is located beteen said sheet feeder and said sheet restorer, and said circulating belt is located below said original sheet container.

* * * * *